US006161528A

United States Patent [19]

Akao et al.

[11] Patent Number: 6,161,528

[45] Date of Patent: Dec. 19, 2000

[54] RECIRCULATING EXHAUST GAS COOLING DEVICE

[75] Inventors: Yoshiyuki Akao; Norio Nakazawa; Hiroshi Ogita, all of Yokohama, Japan

[73] Assignee: Mitsubishi Jidosha Kogyo Kabushiki Kaisha, Japan

[21] Appl. No.: 09/182,282

[22] Filed: Oct. 29, 1998

[30] Foreign Application Priority Data

Oct. 29, 1997 [JP] Japan ..... 9-334742
Nov. 11, 1997 [JP] Japan ..... 9-346986

[51] Int. Cl.[7] ..... F02M 25/07

[52] U.S. Cl. ..... 123/568.12; 165/88

[58] Field of Search ..... 123/568.12; 60/605.2; 165/86, 88, DIG. 139, DIG. 140, DIG. 141, DIG. 143

[56] References Cited

U.S. PATENT DOCUMENTS

| | | | |
|---|---|---|---|
| 1,617,815 | 2/1927 | Lissauer et al. | 165/DIG. 143 |
| 4,044,824 | 8/1977 | Eskeli | 165/DIG. 141 |
| 4,134,377 | 1/1979 | Bamsey et al. | 123/568.12 |
| 4,291,760 | 9/1981 | Argvle et al. | 123/568.12 |
| 4,986,345 | 1/1991 | Uemura et al. | 165/86 |
| 5,203,311 | 4/1993 | Hitomi et al. | 123/568.12 |
| 5,295,533 | 3/1994 | Ueno | 165/88 |
| 5,732,688 | 3/1998 | Charlton et al. | 123/568.12 |
| 5,832,992 | 11/1998 | Van andel | 165/88 |

FOREIGN PATENT DOCUMENTS

| | | |
|---|---|---|
| 2-14570 | 1/1990 | Japan . |
| 7-317918 | 12/1995 | Japan . |

*Primary Examiner*—Willis R. Wolfe
*Attorney, Agent, or Firm*—Rossi & Associates

[57] ABSTRACT

A recirculating exhaust gas cooling device is provided for cooling exhaust gas of a vehicle engine while the exhaust gas is recirculating through an EGR system designed to lower NOx emission levels. The cooling device includes a housing in which an exhaust gas recirculation passage and a cooling fluid passages are located next to each other, to extend in parallel with each other, and a heat-exchange core member rotatably provided in the housing and defining a multiplicity of passages that extend in substantially parallel with a rotational axis of the core member, and a rotating mechanism that rotates the core member. The multiple passages of the core member communicate with both of the exhaust gas recirculation passage and the cooling fluid passage. With the core member being rotated, EGR gas passing through the exhaust gas recirculation passage is cooled by a part of the passages of the core member that has been cooled by a cooling fluid passing through the cooling fluid passage.

10 Claims, 7 Drawing Sheets

RECIRCULATING EXHAUST GAS COOLING DEVICE

FIELD OF THE INVENTION

The present invention relates to a recirculating exhaust gas cooling device for a vehicle engine, such as a diesel engine installed on a truck or other vehicle.

BACKGROUND OF THE INVENTION

Exhaust gas recirculation systems (that may be called "EGR systems") are known which are designed to reduce nitrogen oxides (NOx) as harmful components contained in exhaust gases emitted from vehicle engines, such as diesel engines of trucks. The EGR system is adapted to mix a part of exhaust gas of the engine with the intake air of the same engine so as to restrict or lower the combustion temperature and pressure. The exhaust gas recirculated by the EGR system may also be called "EGR gas".

In the engine equipped with the EGR system, the recirculation of high-temperature exhaust gas into the intake air results in an increase in the intake air temperature and a reduction in the volume efficiency, and the engine performance, such as an engine output and fuel economy, may deteriorate. In some cases, the recirculating exhaust gas affects the combustion of an air-fuel mixture, and causes such problems as an increase in other harmful components, including black smoke, in the exhaust gas.

In view of the above problems, various types of recirculating exhaust gas cooling devices (that may be called "EGR cooler") have been proposed and used in practice, for cooling the EGR gas to lower the intake air temperature, for an accordingly improved volume efficiency, so as to improve the engine output, fuel economy and the quality of the exhaust gas.

In the conventional EGR coolers, plate-fin type and multipipe type cooling devices having substantially the same structure as radiators for cooling a coolant of the engine are widely used. In this type of cooling device, however, a large pressure loss occurs when the exhaust gas passes through the EGR cooler, thus making it necessary to increase the volume and weight of the EGR cooler so as to supply a required amount of cooled EGR gas to the engine.

Where the amount of the recirculating EGR gas is to be further increased to reduce a larger amount of NOx in the exhaust gas, and, in particular, where the EGR gas flows into the intake passage of an engine equipped with a supercharger having a high intake air pressure, passages formed through a heat exchanger (core portion) of the plate-fin type or multipipe type EGR need to have an increased cross-sectional area, in order to reduce the pressure loss of the exhaust gas passing through the EGR cooler, and increase the flow rate of the exhaust gas. With the increase in the cross-sectional area of the passages, the volume of the EGR cooler is accordingly increased, resulting in an increased weight of the cooler, and a difficulty in installation of the cooler on the vehicle. In addition, the plate fin type or multipipe type EGR cooler suffers from deposition of unburned substances of the fuel on its pipe walls, since the EGR gas always flows through the cooler only in one direction. Consequently, the cross-sectional area of the passages of the pipes is reduced with the lapse of time in use, and the heat exchanging capability, or cooling capability, deteriorates due to an increase in the pressure loss.

In the meantime, rotary heat exchangers as disclosed in Japanese Laid-open Utility Model Publication No. 2-14570 and Japanese Laid-open Patent Publication No. 7-31718 are known as devices for heating the intake air utilizing high-temperature exhaust gas in gas turbine engines. The rotary heat exchanger includes a heat-exchange core member that is rotatably disposed in a housing in which an intake air passage and an exhaust air passage are located in parallel with each other and next to each other. The heat-exchange core member is formed with a multiplicity of passages that extend in substantially parallel with the rotational axis of the core member, such that these passages communicate with both of the exhaust gas passage and the intake gas passage. This type of rotary heat exchanger, however, has not been used for the EGR cooler.

SUMMARY OF THE INVENTION

The present invention was developed in view of the above-described situations. It is therefore an object of the present invention to provide a small-sized, light-weight, inexpensive EGR cooler which can be easily installed on the vehicle, and which has excellent cooling capability and durability, and provides reduced pressure loss of exhaust gas passing therethrough, thus assuring a sufficient amount of cooled EGR gas to be supplied to the engine.

To accomplish the above object, the present invention provides a recirculating exhaust gas cooling device comprising: an exhaust gas recirculation passage through which a part of exhaust gas of an engine recirculates, to enter a cylinder of the engine along with intake air; a cooling fluid passage through which a cooling fluid passes; a housing in which the exhaust gas recirculation passage and the cooling fluid passage are located next to each other, to extend in parallel with each other; a heat-exchange core member provided in the housing such that the core member is rotatable about a rotational axis that extends in substantially parallel with the exhaust gas recirculation passage and the cooling fluid passage, the core member defining a multiplicity of passages that extend in substantially parallel with the rotational axis of the core member, the multiplicity of passages communicating with both of the exhaust gas recirculation passage, and the cooling fluid passage; and a rotating mechanism that rotates the core member. With this arrangement, a small-sized, inexpensive EGR cooler can be provided which has excellent heat-exchange efficiency and is able to effectively cool the EGR gas.

In one preferred form of the present invention, the core member consists of a columnar member made of a ceramic material. The core member made of a ceramic material has excellent heat resistance, and provides a sufficiently large heat-exchange area per unit volume.

Preferably, the opening rate of the core member is held in a range of 50 to 80%. With the opening rate set to this range, the pressure loss of the exhaust gas and cooling fluid flowing through the core member can be reduced, and the cooling efficiency of the EGR gas can be increased. Also, the flow rate of the EGR gas, namely, the amount of supply of the EGR gas into the engine, can be increased.

The porosity of the ceramic material of the core member is preferably held in the range of 10 to 30%. The ceramic core member having this range of porosity can be produced at a low cost, utilizing the technique and equipment for producing ceramic catalyst supports of three way catalytic converters that are widely employed for purifying exhaust gases of vehicle engines.

In another preferred form of the invention, a metallic casing is fixed to an outer circumferential surface of the core member made of a ceramic material, and the above-indicated rotating mechanism is provided on the outer periphery of the metallic casing. The rotating mechanism may be easily installed on the outer periphery of the metallic casing, and the structure of a portion of the core member around its rotational axis may be simplified, which leads to a reduction in the size of the core member.

The metallic casing is preferably fitted on the outer circumferential surface of the core member by press fitting or shrinkage fitting. In this case, the core member and the metallic casing can be easily and securely fixed to each other.

At least one torque transmitting member is preferably formed on the inner circumferential surface of the metallic casing to extend in a substantially radial direction(s) of the casing. With the torque transmitting member thus provided, the rotary motion of the metallic casing can be surely transmitted to the core member.

In another preferred form of the invention, the rotating mechanism includes a belt groove formed in an outer circumferential surface of the metallic casing, a belt that engages with the belt groove, and a pulley that is driven by a drive device, such as an electric motor, so as to rotate the belt. This arrangement makes it easy to repair the rotating mechanism or replace its components by new ones.

In the recirculating exhaust gas cooling device of the present invention, the hydraulic diameter of each of the passages of the core member is held in the range of 0.3 mm to 1.0 mm. By controlling the cross-sectional area of the passages in this manner, the pressure loss of the EGR gas and cooling fluid, especially that of the EGR gas, can be reduced, and the heat exchange efficiency can be improved, to thus achieve effective cooling of the EGR gas. Thus, the EGR cooling device of the invention is able to supply a sufficient amount of EGR gas to the engine even if its size is relatively small.

The recirculating exhaust gas cooling device may further include at least one sliding member provided at a sliding portion between the housing and the core member. The sliding member is preferably formed of a solid lubricating material containing one of copper, carbon, fluoride, and oxide. If the sliding member that slides on an end face of the rotating ceramic core member is made of a solid lubricating material containing copper, carbon, fluoride or oxide, in particular, made of aluminum bronze, the friction of the sliding portion at a high temperature can be reduced, and the driving capacity of the drive device can be reduced, while damages, such as chipping of end faces of the core member, can be effectively avoided. In addition, since the core member is rotated, the EGR gas and the cooling fluid pass through the same passages of the core member, in reverse directions, thereby preventing clogging of the passages due to unburned substances of the fuel.

BRIEF DESCRIPTION OF THE DRAWINGS

The invention will be described in detail with reference to certain preferred embodiments thereof and the accompanying drawings, wherein.

DETAILED DESCRIPTION OF THE PREFERRED EMBODIMENTS

Preferred embodiments of the present invention will be described in detail with reference to the accompanying drawings.

Figure 1:
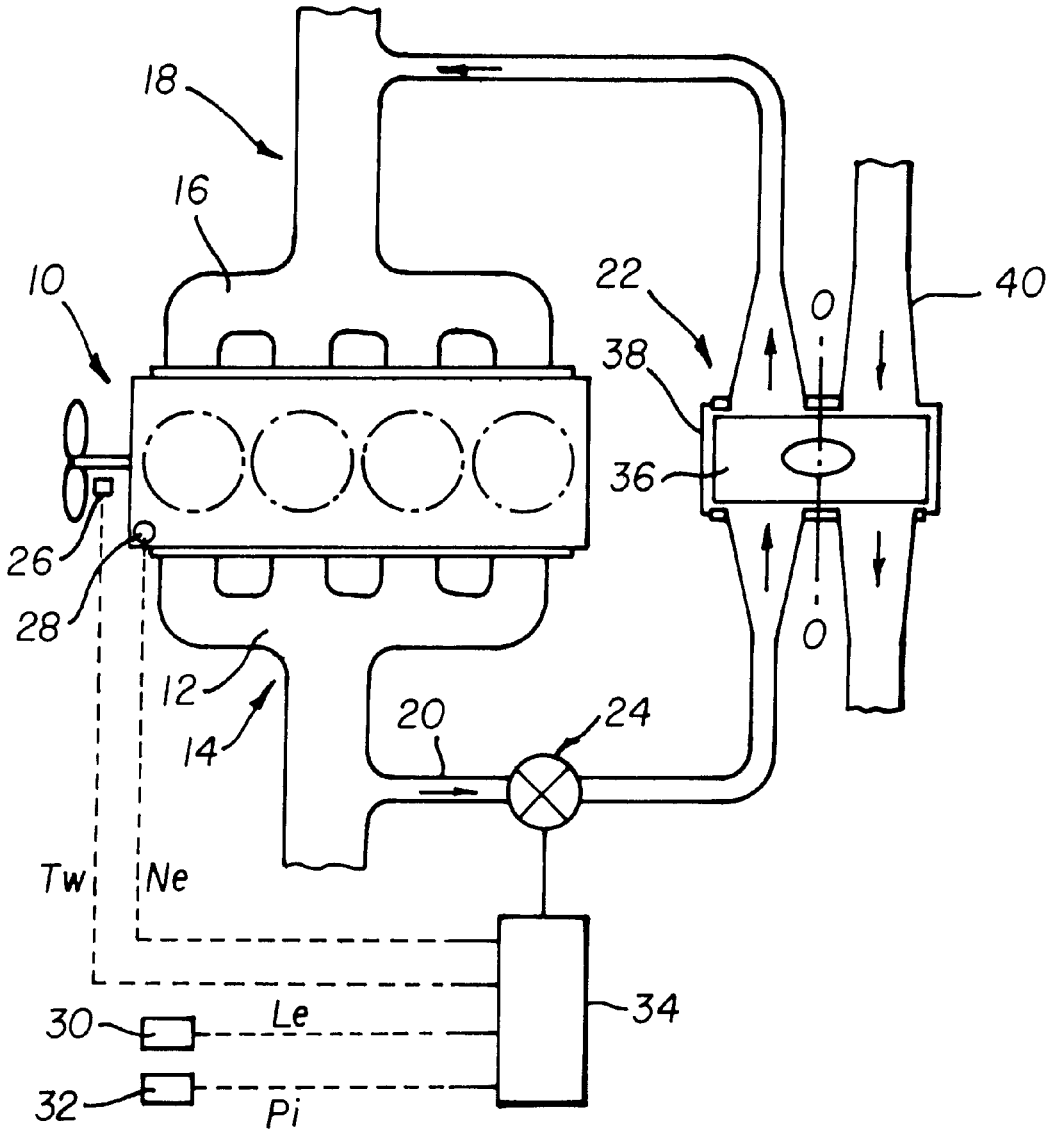
FIG. 1 is a schematic view showing the construction of an engine as a whole including a recirculating exhaust gas cooling device according to one embodiment of the present invention.

Referring first to FIG. 1, a four-cycle, multiple cylinder diesel engine 10 (four cylinders in the engine of FIG. 1) is provided with an exhaust passage 14 a part of which is defined by an exhaust manifold 12, and an intake passage 18 a part of which is defined by an intake manifold 16. The engine 10 is also provided with an exhaust gas recirculation passage 20 (that may be called "EGR passage" in some cases) having one end (upstream end) communicating with a suitable location of the exhaust passage 14, and the other end (downstream end) communicating with a suitable location of the intake passage 18. An EGR cooler generally denoted by reference numeral 22 is mounted in the EGR passage 20, and an EGR valve 24 is disposed upstream of the EGR cooler 22 in the EGR passage 20. The EGR valve 24 with a variable opening serves to control the flow rate of recirculating exhaust gas.

The EGR valve 24 is controlled by a control unit 34 that receives signals indicative of various operating conditions of the engine 10, so as to determine an appropriate amount of EGR gas to be supplied to the engine 10, and determine the opening of the valve 24 according to the EGR gas amount thus determined. For example, the control unit 34 receives such signals as an engine speed signal Ne from an engine speed sensor 26 that detects the speed of rotation of the engine 10, a water temperature signal Tw from a temperature sensor 28 that detects the temperature of the cooling water or coolant of the engine 10, a load signal Le from a load sensor 30 of the engine 10, an intake pressure signal Pi from a pressure sensor 32 that detects the intake pressure in the intake passage 18, and other signals.

The EGR cooler 22 includes a heat-exchange core member 36 (hereinafter simply referred to as "core member") that is driven by a drive device, such as an electric motor, to be rotated about a rotational center axis O—O at a relatively slow speed, and a housing 38 that houses the core member 36. The inner space of the housing 38 communicates with the above-indicated EGR passage 20, and also with a cooling fluid passage 40. Cooling gas, which is preferably air, passes through the cooling fluid passage 40 in the direction as indicated by downward arrows in FIG. 1. The cooling gas may be suitably selected from air discharged from an air compressor or fan that is separately provided, or air passing through a radiator (not illustrated) for cooling the coolant of the engine 10.

Figure 2:
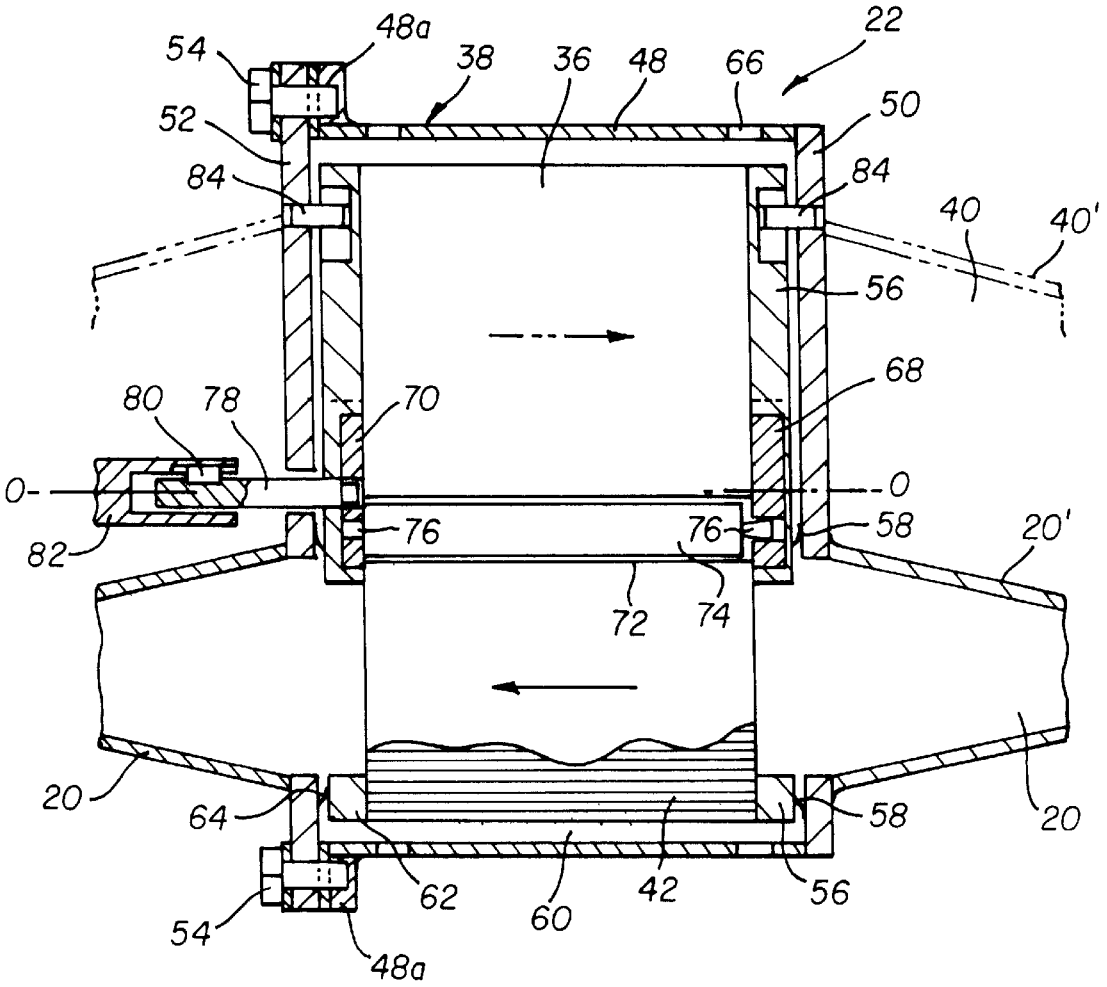
FIG. 2 is an enlarged, cross-sectional view (taken along line II—II in FIG. 3), showing an EGR cooler for the engine of FIG. 1.
Figure 3:
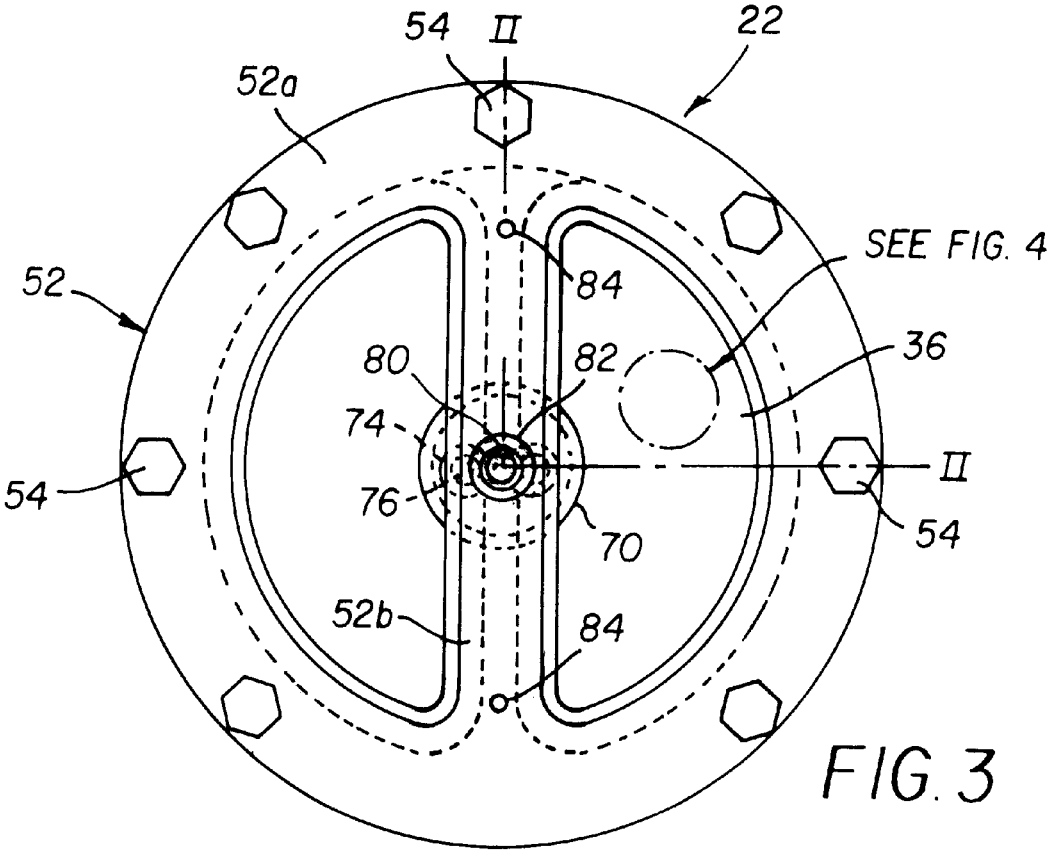
FIG. 3 is a front view of the EGR cooler shown in FIG. 2.
Figure 4:
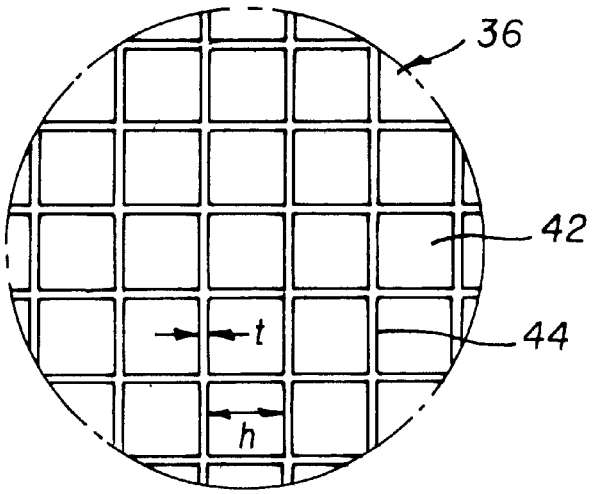
FIG. 4 is an enlarged front view showing a part of a core member of the EGR cooler of FIG. 3.

The construction of the EGR cooler 22 is shown in detail in the cross-sectional view of FIG. 2 (taken along line II—II in FIG. 3), front view of FIG. 3 (as viewed from the side of an EGR gas inlet), and the enlarged fragmentary view of FIG. 4.

The core member 36 consists of a columnar member that rotates about the center axis O—O. Preferably, the core member 36 is made of a ceramic material, such as cordierite or $Li_2.Al_2O.4SiO_2$, and may be produced by, for example, extrusion molding as employed for forming a catalyst support of a catalytic converter that has been widely used for purifying exhaust gases of vehicle engines.

As shown in the enlarged fragmentary view of FIG. 4, a multiplicity of through passages 42 each having a small cross-sectional area are formed through the inside of the core member 36, to extend in substantially parallel with the above-indicated rotational axis O—O. Each of the passages 42 has a square shape in cross section with one side having a length of "h", and the thickness "t" of a partition wall 44 that defines the passages 42 is made as small as possible in a permissible range in which the wall 44 can be formed by a known technique and the required strength of the core member 36 is satisfied. For example, the thickness "t" is controlled to 0.1 mm.

By setting the thickness "t" of the partition wall 44 to the possibly smallest value, the opening rate of the core member 36, namely, the ratio of the total cross-sectional area of the passages 42 to the cross-sectional area of a circle whose diameter is equal to the outside diameter of the core member 36, can be made sufficiently large. With the core member 36 having such a large opening rate, the pressure loss of the EGR gas and cooling fluid passing through the core member 36 can be reduced, and the flow rates of these gases can be increased, as described later.

The core member 36 is accommodated in the cylindrical housing 38 having opposite end faces (as viewed in the direction of the axis O—O) to which are connected ducts 20' and 40' that define the EGR passage 20 and cooling fluid passage 40, respectively.

The housing 38 consists of a cylindrical, outer circumferential wall 48, and end plates 50 and 52 located at the opposite ends thereof as viewed in the axial direction. As shown in FIG. 3, the end plate 52 disposed on the downstream side of the EGR passage 20 has a θ-like shape as seen in the front view, namely, the end plate 52 consists of an annular frame portion 52*a*, and a bridge portion 52*b* extending in the diametral direction. The frame portion 52*a* is detachably secured by a large number of bolts 54 to a flange 48*a* formed at an end portion of the outer circumferential wall 48. On the other hand, the end plate 50 disposed on the upstream side of the EGR passage also has a θ-like shape similar to that of the end plate 52 at the other end, and is fixed by welding, or other method, to the other open end of the outer circumferential wall 48.

The EGR passage 20 is connected to one of two semicircular openings of each of the end plates 50, 52 having the above θ-like shape, and the cooling fluid passage 40 is connected to the other semicircular opening. A seal plate or sliding member 56 having a θ-like shape is interposed between the end plate 50 on the upstream side of the EGR passage, and an end face of the core member 36 that faces the end plate 50. The sliding member 56 is made of a solid lubricating material containing copper, carbon, fluoride, or oxide, preferably, aluminum bronze. The sliding member 56 is pressed against the upstream end face of the core member 38, via a seal diaphragm 58 formed by a thin plate of heat-resistant stainless steel or inconel. The seal diaphragm 58 shuts off fluid communication between the EGR passage 20 and an annular space 60 between the outer circumferential wall 48 of the housing 38 and the outer circumferential surface of the core member 36.

Similarly, a θ-shaped, or semicircular or D-shaped sliding member 62 preferably made of aluminum bronze is interposed between the end plate 52 on the downstream side of the EGR passage 20, and an end face of the core member 36 that faces the end plate 52. The sliding member 62 is pressed against the downstream end of the core member 36, with a D-shaped seal diaphragm 64 interposed therebetween on the side of the EGR passage. The seal diaphragm 64 is formed by a thin plate of heat-resistant stainless steel or inconel, and serves to shut off fluid communication between the above-described annular space 60 and the EGR passage 20. A suitable number of annular space 60 communicates with the atmosphere through the holes 66, whereby an increase in the temperature of the annular space 60 is favorably prevented.

Core support plates 68, 70 having a disc-like shape and being coaxial with the core member 36 are fitted in central portions of the sliding members 56, 62, such that the plates 68, 70 are rotatable relative to the core member 36. Support shafts 76 that protrude from opposite end portions of pipe members 74 are fitted in the core support plates 68, 70. The pipe members 74 that assist in driving the core member 36 are inserted through in one or a plurality of cylindrical bores 72 (two in this embodiment) that are formed in advance through the core member 36 in the axial direction and located eccentrically with respect to the rotational axis O—O of the core member 36.

One end of a drive shaft 78 is screwed into and fixed to one of the support plates, i.e., the core support plate 70 on the downstream side of the EGR passage in the case of FIG. 2, and the other end of the drive shaft 78 is connected via a key 80 to an output shaft 82 of a drive device, such as an electric motor, equipped with reduction gears (not illustrated). As shown in FIG. 2 and FIG. 3, lock pins 84 are provided between the end plates 50, 52 and the seal plates 56, 62, so as to inhibit the seal plates 56 and 62 from rotating in accordance with rotation of the core member 36.

In the system constructed as described above, part of the exhaust gas discharged into the exhaust passage 14 is allowed to flow through the EGR passage 20 during the operation of the engine 10, such that the flow rate of the exhaust gas is controlled by the EGR valve 24 whose opening is controlled by the control unit 34 depending upon operating conditions of the engine 10.

In the meantime, the drive device as described above rotates its output shaft 82 at a relatively low speed, so as to rotate the core support plate 70 at the same angular velocity, via the key 80 and the drive shaft 78. The rotation of the support plate 70 is transmitted to the core member 36 through the pipe members 74 and the core support plate 68, so that the core member 36 is rotated at a relatively low speed.

With the core member 36 rotated in the above manner, a cooling fluid flows from the cooling fluid passage 40 into a substantially half number of the numerous passages 42 each having a small cross-sectional area and extending in the axial direction, so as to cool the partition wall 44 defining that part of the passages 42. On the other hand, high-temperature EGRR gas flows from the EGR passage 20 into the remaining half number of passages 42, and is brought into contact with the partition wall 44 that has been cooled by the cooling fluid. The EGR gas, after it is cooled upon contact with the partition wall 44, is supplied to the intake passage 18 of the engine 10, for mixture with intake air, and then supplied to a combustion chamber of the engine 10.

Since the cooled EGR gas is supplied, along with the intake air, to the combustion chamber of the engine, the volume efficiency is increased, and the output and fuel economy of the engine are improved, while assuring improvements in the quality of exhaust gas, e.g., reduced black smoke.

As described above, the drive device drives the ceramic core member 36 at its central portion, via the core support plates 70, 68 and the pipe members 74. Thus, the core member 36 can be safely and surely rotated while enduring a load of drive torque, in spite of the intrinsic fragility of the ceramic material, and can be driven by a small-sized, light-weight, inexpensive drive system. As also described above, the sliding members 56, 62 that are in sliding contact with the axially opposite end faces of the core member 36 during its rotary motion are formed of a solid lubricating 20 material containing copper, carbon, fluoride or oxide, or preferably, aluminum bronze. Accordingly, the sliding members 56, 62 provide a sufficiently small coefficient of friction at a high temperature, and are therefore kept from damaging the end faces of the core member 36 on which these members 56, 62 slide. Furthermore, the sliding members 56, 62 may be easily formed by casting, into a rather complicated shape.

The core member 36 is made of a ceramic material, in particular, cordierite or $Li_2O.Al_2O_3.4SiO_2$, such that its porosity is controlled to be in the rage of 10 to 30%. Thus, the core member 36, which has a multiplicity of passages 42 with small cross-sectional areas and cylindrical bores 72, can be easily produced at a low cost by extrusion molding, using a conventional technique for producing catalyst supports that have been manufactured in large quantity and widely used in catalytic converters for purifying exhaust gases of vehicle engines.

The heat-exchange capacity of a given volume of core member 36 suitable for installation on the vehicle, with EGR gas and cooling fluid, in particular, with EGR gas, has certain relationships with the heat-exchange area in contact with the EGR gas or other gas, namely, the surface area of the partition wall 44 defining the numerous passages 42, and the pressure loss of the EGR gas flowing through the passages 42, namely, the flow rate of the EGR gas flowing through the core member 36. In one type of engine equipped with a turbocharger wherein a gas turbine is driven using exhaust gas of the engine as an operating or driving medium, and an air compressor for applying a pressure to the intake air is drive by the gas turbine, in particular, the difference between the exhaust gas pressure and the intake air pressure is made small due to a high pressure of the intake air in the intake passage 18, and the supply amount of the EGR gas into the engine tends to be reduced. In this type of engine, it is particularly important to reduce the pressure loss, so as to ensure a sufficiently large flow rate of the EGR gas.

Figure 5:
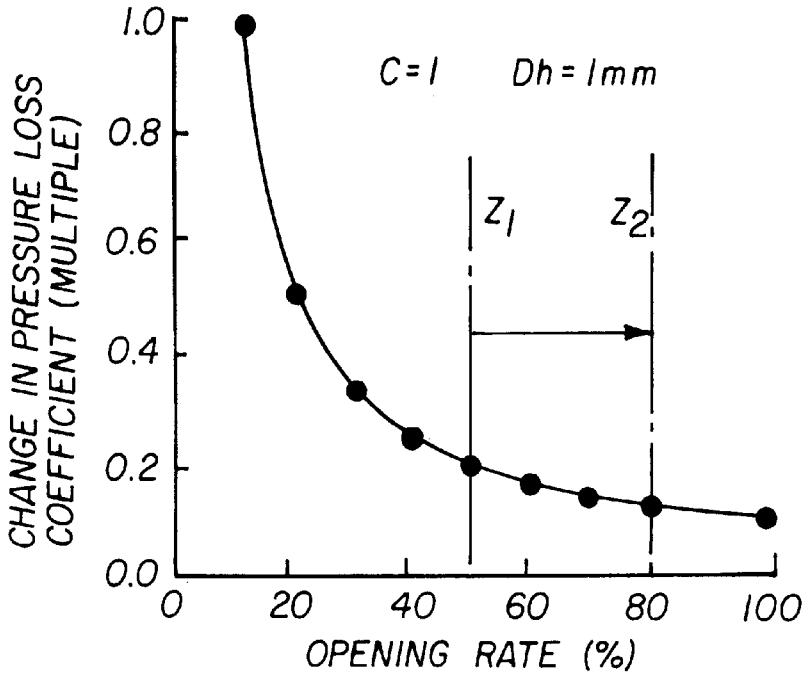
FIG. 5 is a graph showing the relationship between the opening rate of the core member and the pressure loss coefficient.

The graph of FIG. 5 shows the relationship between the opening rate δ c % of the core member 36 and increases and decreases in the pressure loss coefficient, namely, changes in the power loss when 100% of opening rate is regarded as 1. The opening rate δ c % is a value obtained by dividing the total cross sectional area of the numerous passages 42 of the core member 36 in the plane perpendicular to the rotational axis O—O by the cross sectional area of the core member 36 in the same plane, and multiplying the result by 100. In the graph of FIG. 5, $C=16F(\alpha)L\upsilon G\rho/(\pi D^2)$, namely, constant C determined only by the shape of the passages 42 is equal to 1, and the diameter of the circle whose cross sectional area is equivalent to that of the passages 42, namely, the hydraulic diameter $D_h$, is equal to 1 mm.

As is apparent from the graph of FIG. 5, the power loss rapidly decreases with an increase in the opening rate δ c, but the range between 50% to 80% of opening rate as defined by vertical lines $Z_1$ and $Z_2$ in FIG. 5 is favorably employed in practical use, in view of the relationship with the strength of the partition wall 44 defining the passages 42. In the above-indicated expression representing constant C, F(α) is a function of the passage shape that determines the coefficient of friction of the passages 42, L is length of the passages 42 as measured in the axial direction, υ is coefficient of kinematic viscosity of the EGR gas or cooling fluid, G is flow rate of the EGR gas or cooling fluid, ρ is density of the EGR gas or cooling fluid, and D is the outside diameter of the core member 36.

Figure 6:
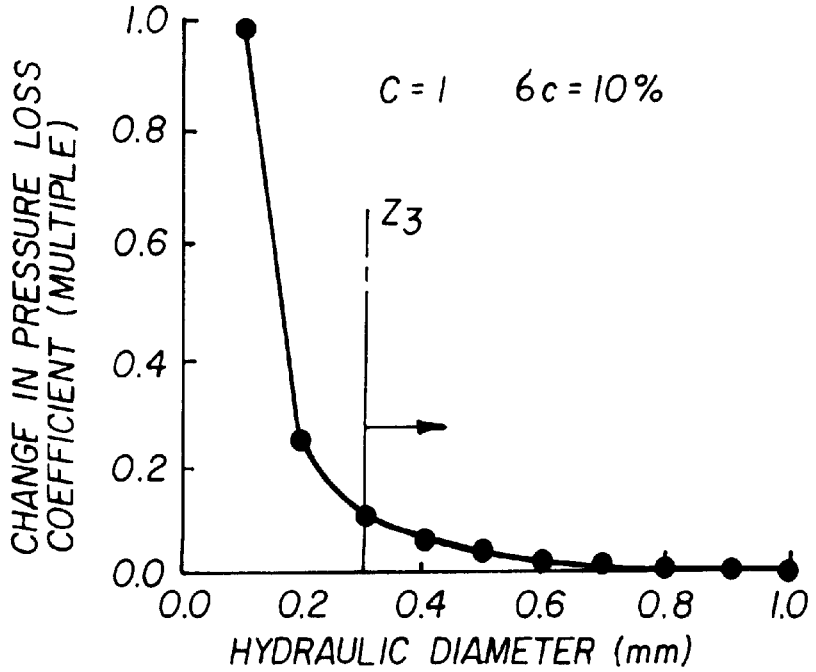
FIG. 6 is a graph showing the relationship between the hydraulic diameter of passages of the core member, and the pressure loss coefficient.

In the graph of FIG. 6, the horizontal axis indicates the hydraulic diameter $D_h$ (mm) of the passages 42, and the vertical axis indicates increases and decreases (multiple) of the pressure loss coefficient, where C is equal to 1 (constant), and the opening rate δ c is equal to 10%, as in the graph of FIG. 5. As shown in FIG. 6, it was confirmed that the hydraulic diameter $D_h$ is favorably controlled to be within the range of 0.3 mm (indicated by vertical line $Z_3$) to 1 mm.

Figure 7:
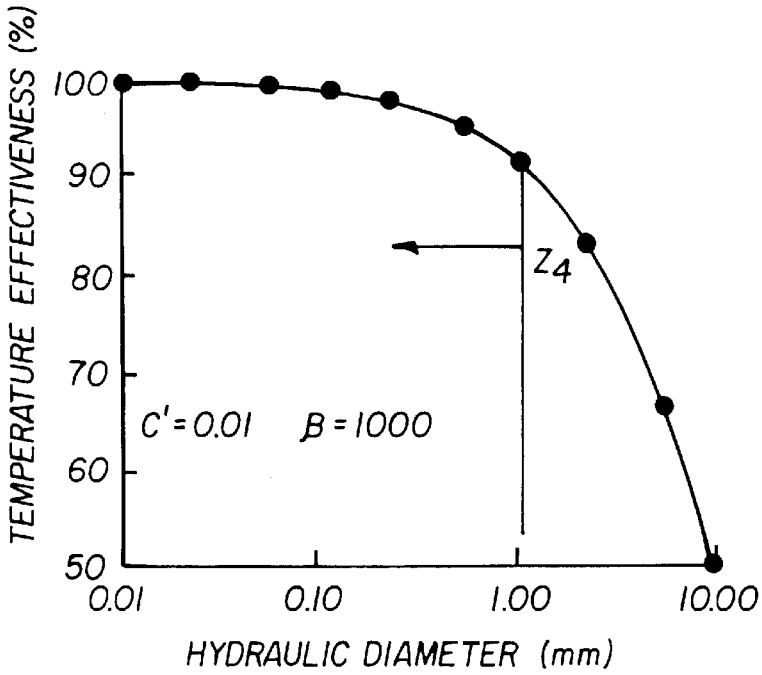
FIG. 7 is a graph showing the relationship between the hydraulic diameter of passages of the core member and the temperature effectiveness.

The graph of FIG. 7 shows the relationship between the hydraulic diameter $D_h$ taken along the horizontal axis, and the temperature effectiveness (%) taken along the vertical axis, under conditions that constant $C'=(\lambda N_u D^2)/(8cp G)=0.01$ and β=heat transfer area ($m^2/m^3$) per unit volume of passages 42, where λ is thermal conductivity of the EGR gas or cooling fluid, $N_u$ is Nusselt number of the EGR gas or cooling fluid, D is outside diameter of the core member 36, cp is specific head of the EGR gas or cooling fluid, and G is flow rate of the EGR gas or cooling fluid. As is apparent from the graph of FIG. 7, the temperature effectiveness is advantageously 90% or greater when the hydraulic diameter of the passages 42 is equal to or smaller than 1 mm, as indicated by vertical line $Z_4$.

Figure 8:
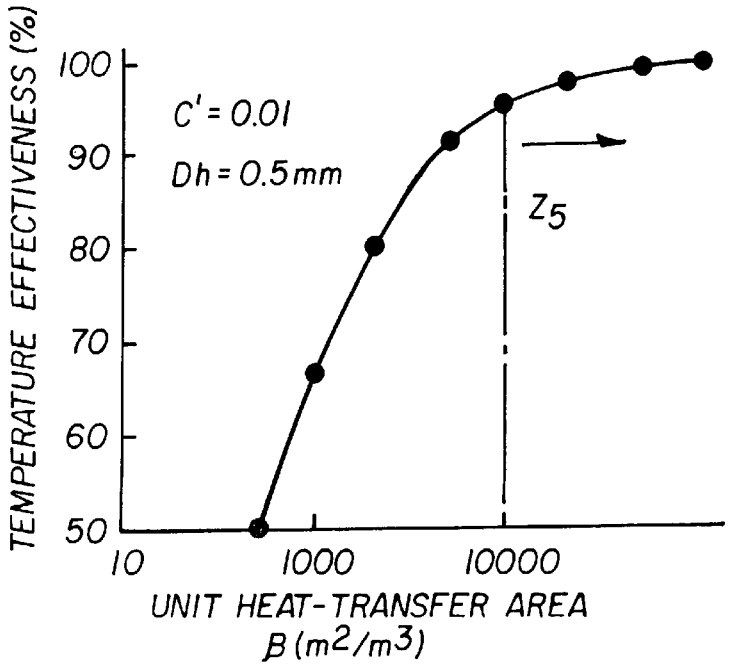
FIG. 8 is a graph showing the unit heat-transfer area of the core member and the temperature effectiveness.

The graph of FIG. 8 shows the relationship between the unit heat transfer area β($m^2/m^3$) and the temperature effectiveness (%) under conditions that the above-indicated constant C' is equal to 1, and the hydraulic diameter $D_h$ is equal to 0.5 mm, as in the graph of FIG. 7. It is understood from the graph of FIG. 8 that the temperature effectiveness is favorably about 95% or greater when the heat transfer area β per unit volume is 1000 or larger, as indicated by vertical line $Z_5$ in FIG. 8.

Through overall observation of the graphs of FIG. 5 through FIG. 8, it was confirmed that the opening rate of the core member 36 is preferably in the range of 50 to 80%, and the hydraulic diameter of the passages 42 formed in the core member 36 is preferably in the range of 0.3 to 1.0 mm. With the opening rate and hydraulic diameter controlled to these ranges, the EGR cooler provides a reduced power loss, and has high capability of cooling the EGR gas, assuring high durability and reliability. Further, the EGR cooler can be produced with reduced size and weight, and therefore can be easily installed on the vehicle.

In the illustrated embodiment, each of the numerous passages 42 formed through the core member 36 has a square cross-sectional shape as viewed in the plane perpendicular to the rotational axis O—O of the core member. The passage 42, however, may be formed into a rectangular shape in cross section with different lengths of vertical and horizontal sides, or any other polygonal cross-sectional shape, such as a right pentagon or a right hexagon. Also, the passages 42 may be arranged along concentric circles, such that the individual passages 42 each having a sector form in cross section are defined by a certain number of radial partition walls 44. While each of the EGR gas and the cooling fluid flowing in opposite directions is adapted to pass through a corresponding set of passages 42 within an area that is about halt of that of the circle defined by the core member 36 in the illustrated embodiment, the cross-sectional area of one set of the passages 42 through which the EGR gas passes may differ from that of the other set of the passages 42 through which the coolant fluid passes. Also, the EGR gas and the cooling fluid may flow in the same direction. Further, the drive shaft 78 on the core member 36 may be driven by other drive means, such as a toothed wheel or belt that rotates with the crankshaft of the engine 10. Also, the arrangement of FIG. 1 may be modified such that a part of or the entire volume of EGR gas that has been cooled by the EGR cooler 22 is directly supplied to the combustion chamber through an independent port formed in a cylinder head of the engine 10, without passing through the intake air passage 18 shown in FIG. 1.

Figure 9:
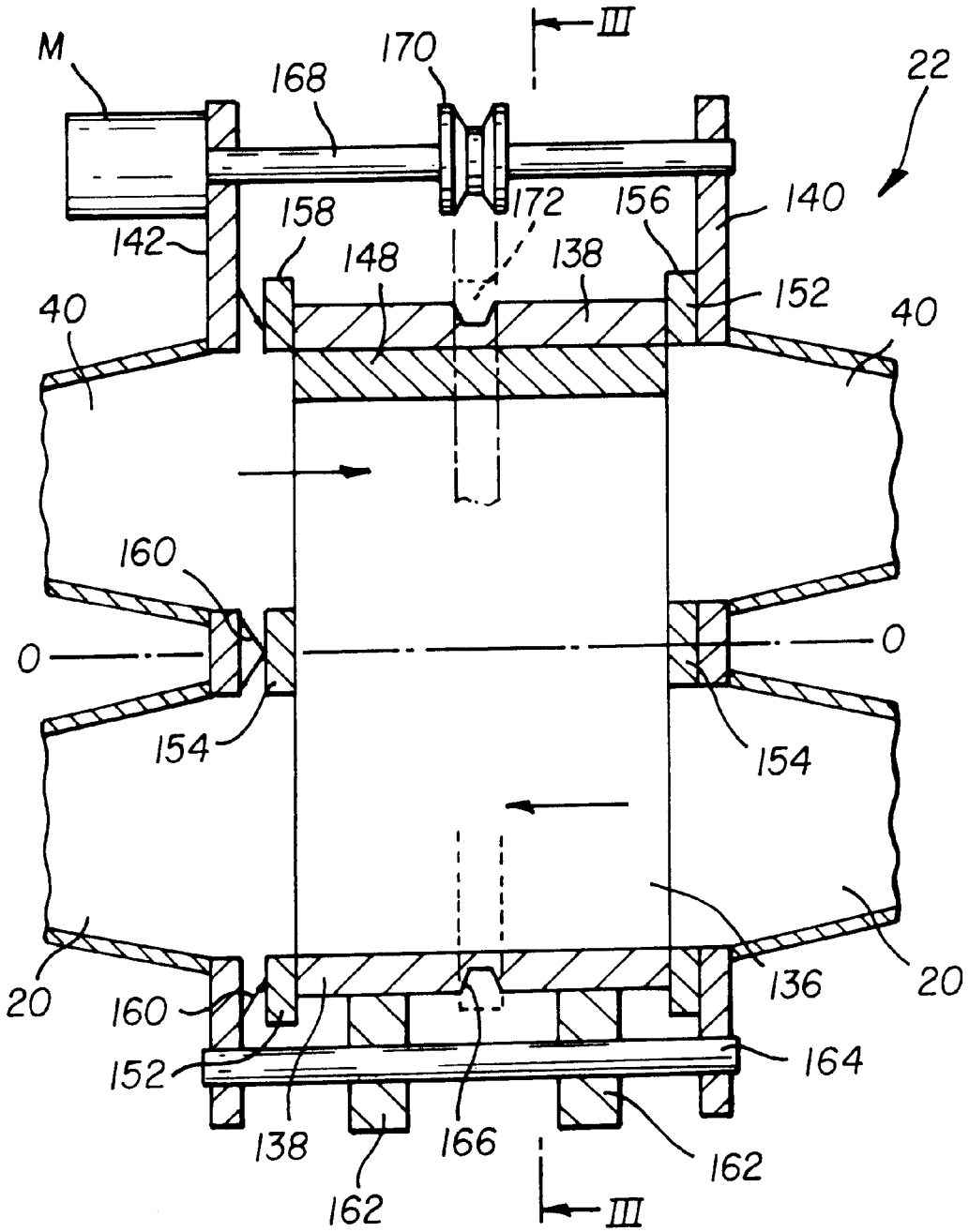
FIG. 9 is an enlarged cross-sectional view (taken along line II—II in FIG. 10) of an EGR cooler according to the second embodiment of the invention.

Next, the second embodiment of the present invention will be described in detail with reference to FIG. 9 and FIG. 10. Although the basic arrangement and the structure of the core member are substantially identical with those of the first embodiment as described above, the EGR cooler of the second embodiment is additionally provided with a casing 138 fitted on a core member 136 as shown in FIG. 9, and its rotating mechanism is different from that of the first embodiment.

The casing 138 fitted on the core member 136 consists of a cylindrical member made of a metallic material, preferably, SUS310 stainless steel, which has excellent heat resistance, and can be easily drawn and processed. For example, the cylindrical member that provides the casing 138 is secured to the outer circumferential surface of the core member 136, by shrinkage fitting conducted at 800–900° C. In the embodiment of FIG. 9, the casing 138 and the core member 136 are formed such that their opposite end faces in the axial direction are included in the same plane perpendicular to the rotational axis O—O of the core member 136.

Figure 10:
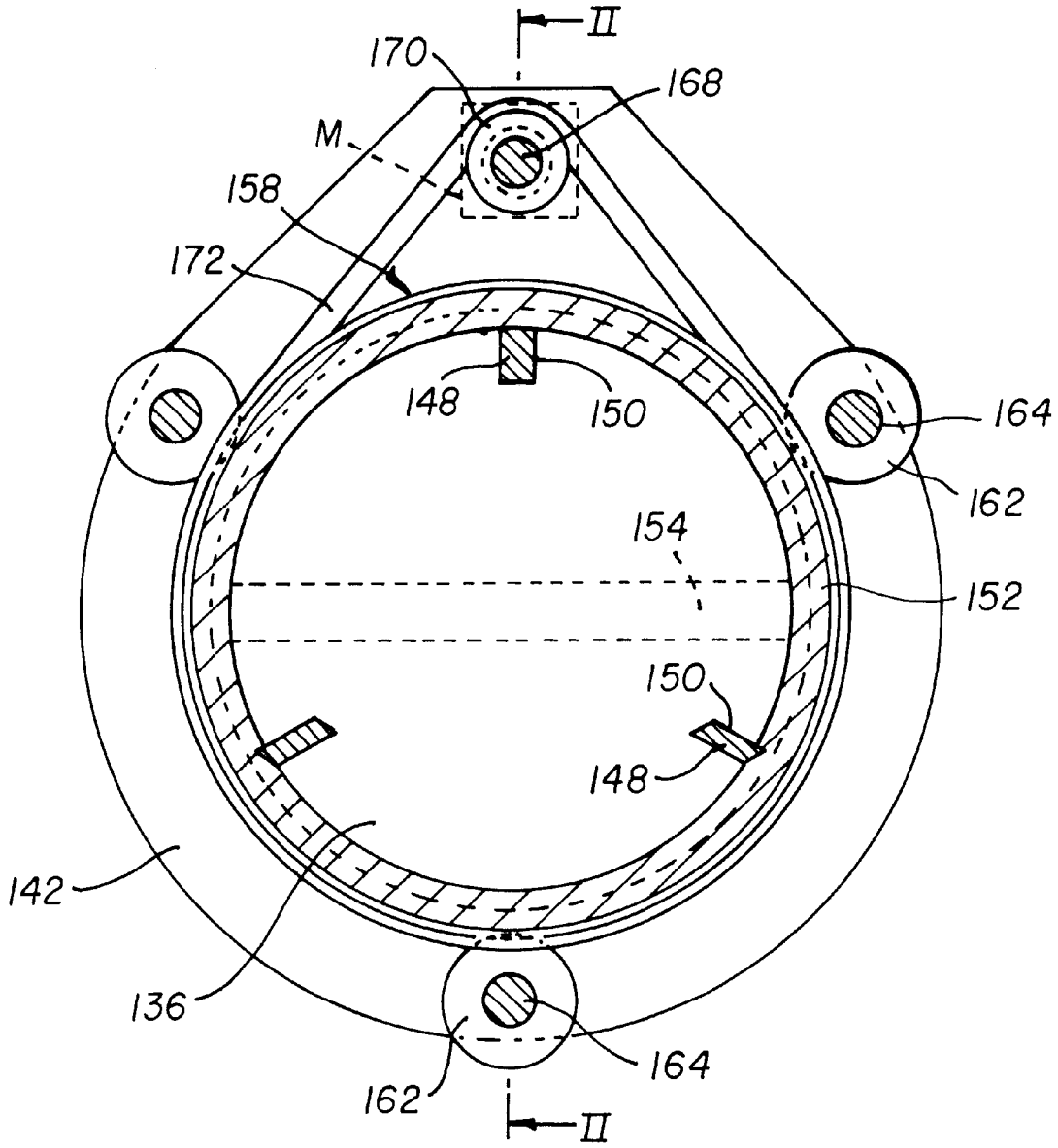
FIG. 10 is a cross-sectional view taken along line III—III of FIG. 9.

To improve the bonding strength (in particular, bonding strength at a high temperature) against rotation of the core member 136 relative to the casing 138 fitted on the outer circumferential surface of the core member 136 by shrinkage fitting or press fitting, it is desirable to provide one or more wings or torque transmitting members 148 that extend from the inner periphery of the casing 138 into the core member 136 in substantially radial directions, as shown in FIG. 10. As shown in the same figure, each of the torque transmitting members 148 is formed by a strip-like member having a rectangular or parallelogramatic shape in cross section as viewed in the plane perpendicular to the rotational axis O—O, and extending in the direction of the rotational axis. One edge of each of the torque transmitting members 148 that faces radially outward is fixed to the casing 138 by welding or other suitable fixing means. On the other hand, the core member 136 is formed with grooves or apertures 150 that receive the torque transmitting members 148. The grooves 150 may be formed at the same time that the core member 136 is formed by extrusion 20 molding, or may be formed by machining an outer peripheral portion of the core member 136 formed into a columnar shape.

First and second seal plates 156 and 158 are disposed on axially opposite end faces of the casing 138. Each of the seal plates 156, 158 consists of an annular portion 152, and a bridge portion 154 that extends in the diametral direction and has opposite ends secured to the annular portion 152. Thus, the seal plate 156, 158 assumes a θ-like shape (as seen in the front view) in which D-shaped or semicircular fluid passages are formed between the annular portion 152 and the bridge portion 154. The first seal plate 156 is directly sandwiched by and between one of opposite end faces of the casing 138 and a first support plate 140, and attached to the support plate 140 by a lock pin or pins (not shown), or the like, so that the seal plate 156 does not rotate relative to the support plate 140. On the other hand, the second seal plate 158 is interposed between the other end face of the casing 138 and a second support plate 142, via a seal diaphragm in the form of a θ-shaped thin plate made of heat-resistance stainless steel or inconel. The second seal plate 158 is also attached to the second support plate 142 by means of a lock pin or pins (not shown) such that the seal plate 158 does not rotate relative to the support plate 142.

Preferably, the first and second seal plates 156 and 158 are formed such that the inside diameter of the annular portion 152 of each seal plate 156, 158 is substantially equal to the inside diameter of the casing 138, so as not to reduce the area of passages of the EGR gas and cooling fluid through the core member 136. When the core member 136 and the casing 138 are rotated as a unit about the rotational axis O—O, the annular portions 152 of the first and second seal plates 156, 158 abut on and slide along the axially opposite end faces of the casing 138, and the bridge portions 154 abut on and slide along the axially opposite end faces of the core member 136. In view of this situation, the seal plates 156 and 158 are desirably made of a material, such as aluminum bronze, that has a small coefficient of friction at a high temperature.

Rollers 162 that abut on the outer circumferential surface of the casing 138 are provided for supporting the casing 138 and the core member 136 rotatably about the rotational axis O—O, and shafts 164 of the rollers 162 (three shafts in the present embodiment) are supported by the first and second support plates 140 and 142 such that the shafts 164 are equally spaced from each other in the circumferential direction. A plurality of rollers 162 (two in the embodiment of FIG. 9) are mounted on each of the roller shafts 164, such that the rollers are spaced from each other in the axial direction.

One or more (one in the present embodiment) belt groove having its center axis in the plane perpendicular to the rotational axis O—O, preferably, a belt groove 166 for receiving a V belt, is formed in the outer circumferential surface of the casing 138, and a pulley 170 having a belt groove that faces the belt groove 166 is fitted on an output shaft 168 of an electric motor M that is mounted on one of support plates, for example, the second support plate 142. Also, a V belt 172 is wound around the casing 138, between the belt groove 155 of the casing 138 and the pulley 170. The belt groove 166, V belt 172 and the pulley 170 constitute a rotating mechanism for rotating the casing 138 and the core member 136 as a unit.

In the arrangement constructed as described above, part of exhaust gas discharged into the exhaust passage 14 is allowed to flow into the EGR passage 20 during the operation of the engine 10, such that the flow rate of the gas is controlled by the EGR valve 24 whose opening is controlled by the control unit 34 depending upon operating conditions of the engine.

In the meantime, the electric motor M is driven to rotate its output shaft 168, and the casing 138 and the core member 136 are rotated as a unit at a relatively low speed, with driving force of the motor M transmitted through the pulley 150 fixed on the output shaft 158, and the V belt 172 wound around the belt groove 166 formed in the outer circumferential surface of the casing 138.

During rotation of the casing 138 and the core member 136, the seal diaphragm 160 interposed between the second support plate 142 and the second seal plate 158 inhibits leakage of the cooling fluid and EGR gas to the exterior of the system. Further, since the first seal plate 156 and the casing 138 fluid-tightly abut on each other due to the elasticity of the seal diaphragm 160, the cooling fluid and EGR gas are also effectively prevented from leaking to the outside through a clearance between the first seal plate 156 and the casing 138.

In the second embodiment, wings or torque transmitting members 148 that extend in substantially radial directions are provided between the core member 136 and the metallic casing 138 fitted on the outer circumferential surface of the core member 136 by press fitting or shrinkage fitting. The torque transmitting members 148, however, may be eliminated in the case where sufficient torque transmission can be achieved only by shrinkage-fitting the casing 138, since the core member 136 may be made compact with reduced size and weight, thus requiring reduced torque for driving this member 136. While the V belt 172 is used for rotating the casing 138 and the core member 136 as a unit in the illustrated embodiment, a flat belt may be employed since the torque to be transmitted is sufficiently small as described above. Further, a metallic belt such as those widely used for CVT as one type of transmission of automobiles may be used to ensure further improved durability at a high temperature.

While the seal diaphragm 160 is provided only on the side of the second seal plate 158 that contacts with one axial end portion of the metallic casing 138 in the illustrated embodiment, a similar seal diaphragm may be provided on the side of the first seal plate 156 that contacts with the other end portion of the casing 138.

What is claimed is:

1. A recirculating exhaust gas cooling device comprising:

an exhaust gas recirculation passage through which a part of exhaust gas of an engine recirculates, to enter a cylinder of the engine along with intake air;

a cooling fluid passage through which a cooling fluid passes;

a housing in which said exhaust gas recirculation passage and said cooling fluid passage are located next to each other, to extend in parallel with each other;

a heat-exchange core member provided in said housing such that the core member is rotatable about a rotational axis, said core member defining a multiplicity of passages that extend in substantially parallel with the rotational axis of the core member, wherein said multiplicity of passages can be rotated between a position within the exhaust gas recirculation passage and a position within the cooling fluid passage; and a rotating mechanism that rotates said core member.

2. A recirculating exhaust gas cooling device as defined in claim 1, wherein each of said multiplicity of passages of said core member has a hydraulic diameter of 0.3 mm to 1.0 mm.

3. A recirculating exhaust gas cooling device as defined in claim 1, further comprising a sliding member provided at a sliding portion between said housing and said core member, said sliding member comprising a solid lubricating material containing one of copper, carbon, fluoride, and oxide.

4. A recirculating exhaust gas cooling device as defined in claim 1, wherein said core member comprises a columnar member made of a ceramic material.

5. A recirculating exhaust gas cooling device as defined in claim 4, wherein said core member has an opening rate that is a range of 50 to 80%.

6. A recirculating exhaust gas cooling device as defined in claim 4, wherein the ceramic material of the core member has a porosity that is in a range of 10 to 30%.

7. A recirculating exhaust gas cooling device as defined in claim 4, further comprising a metallic casing fixed to an outer circumferential surface of said core member, said rotating mechanism being provided on an outer periphery of said metallic casing.

8. A recirculating exhaust gas cooling device as defined in claim 7, wherein said metallic casing is fitted on the outer circumferential surface of said core member by press fitting or shrinkage fitting.

9. A recirculating exhaust gas cooling device as defined in claim 7, further comprising a torque transmitting member formed on an inner circumferential surface of said metallic casing to extend in a substantially radial direction of the casing.

10. A recirculating exhaust gas cooling device as defined in claim 7, wherein said rotating mechanism comprises a belt groove formed in an outer circumferential surface of said metallic casing, a belt that engages with the belt groove, and a pulley that is driven by a drive device so as to rotate the belt.

* * * * *